United States Patent [19]

Tomita et al.

[11] 4,280,266

[45] Jul. 28, 1981

[54] AUTOMATIC BEAD THREADING TOY

[75] Inventors: Tohru Tomita; Shinya Saitoh, both of Tokyo; Kazuo Hirakata, Ichikawa, all of Japan

[73] Assignee: Takara Co., Ltd., Tokyo, Japan

[21] Appl. No.: 112,395

[22] Filed: Jan. 15, 1980

[30] Foreign Application Priority Data

Jan. 26, 1979 [JP] Japan ..... 54-7740[U]

[51] Int. Cl.[3] ..... B25A 19/04

[52] U.S. Cl. ..... 29/241

[58] Field of Search ..... 29/241, 433; 221/205, 221/203; 53/581

[56] References Cited

U.S. PATENT DOCUMENTS

| | | | |
|---|---|---|---|
| 3,791,007 | 2/1974 | Seleznev et al. | 29/233 |
| 3,907,180 | 9/1975 | Birk et al. | 29/241 |

FOREIGN PATENT DOCUMENTS

| | | | |
|---|---|---|---|
| 1449208 | 2/1968 | Fed. Rep. of Germany | 221/205 |

*Primary Examiner*—James L. Jones, Jr.

*Attorney, Agent, or Firm*—Jackson, Jones & Price

[57] ABSTRACT

A toy device adapted for threading beads upon a thread or line is disclosed. A container for beads is mounted to a preferably transparent chassis. The container has an outlet port or hole in a lower part thereof through which beads may fall out of the container one-by-one. A first end of the guide wire or like member is mounted substantially in the center of the outlet port. The container is continuously shaken through a hand actuated crank and ratchet gear assembly. As a result of the shaking, the beads undergo a random motion which eventually causes the beads to fall one-by-one through the outlet port onto the guide wire with the guide wire substantially centered in the central aperture of each bead. A bead advancing assembly which comprises two rotatable members having cut-away portions to capture the beads, is operatively associated with an intermediate portion of the guidewire. The beads are one-by-one advanced over the intermediate portion of the guide wire, from where they slide toward a second end of the guide wire. From the second end of the guide wire the beads slide to a thread or line which is removably attached to the second end of the guide wire.

17 Claims, 6 Drawing Figures

FIG. 1
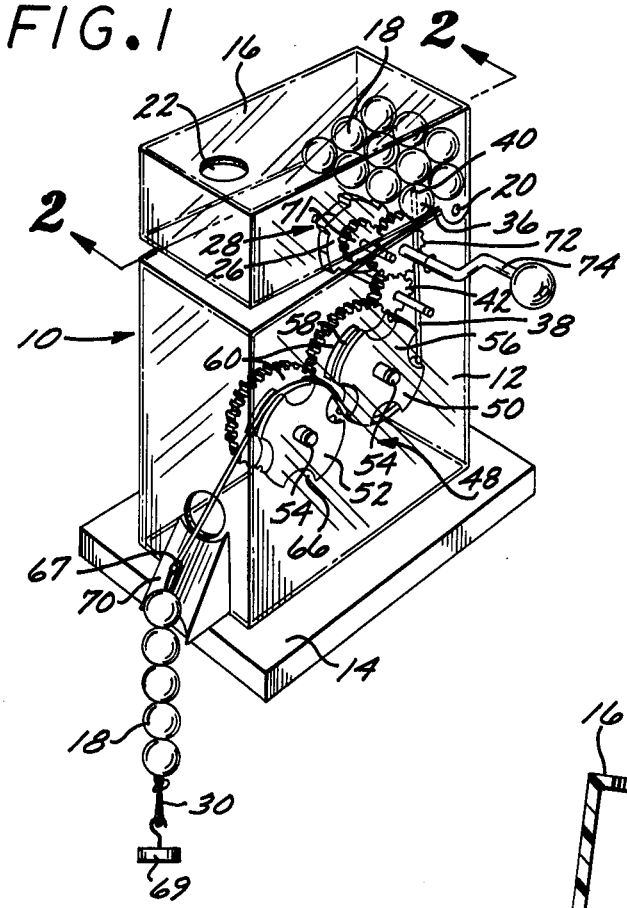
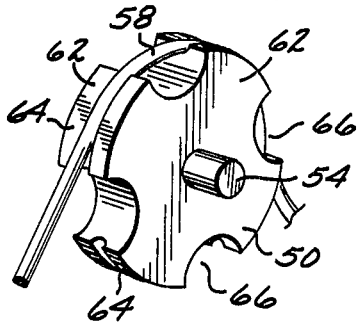
FIG. 3
FIG. 2
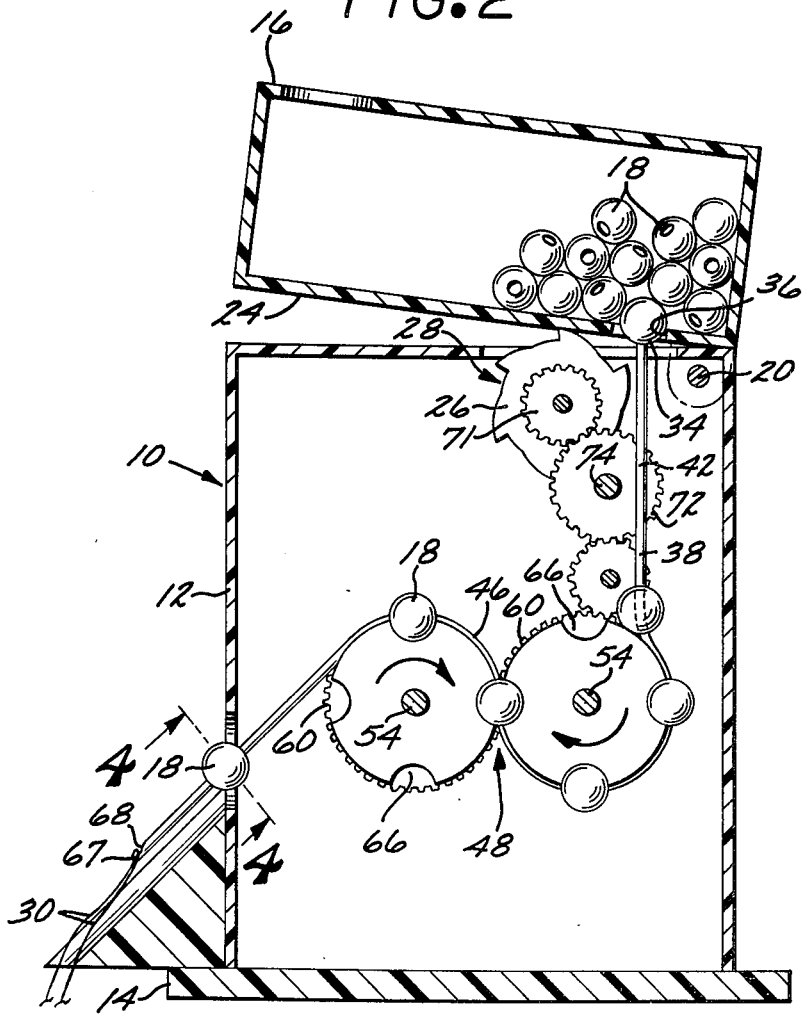
FIG. 4
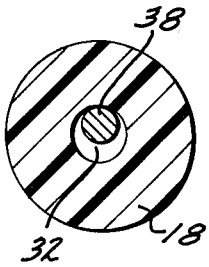

AUTOMATIC BEAD THREADING TOY

BACKGROUND OF THE INVENTION

1. Field of the Invention

The present invention is directed to an automatic bead threading toy, and more particularly to a hand actuated bead threading toy wherein a plurality of beads are passed from a container through a guide wire onto a thread or line.

2. Brief Description of the Prior Art

Beads assembled on a thread or line are often used as toy items, and as inexpensive jewelry for children. Threading beads on a thread or line is, however, time consuming and relatively boring so that it is unable to capture the sustained interest of children. Furthermore, threading beads upon a line by using a needle or like sharp object is dangerous particularly for small children. Therefore, there is a need in the toy manufacturing arts for a relatively inexpensive automatic bead threading toy which renders it possible even for small children to make their own threaded bead jewelry or threaded bead toys.

SUMMARY OF THE INVENTION

It is an object of the present invention to provide an automatic bead threading toy which is relatively inexpensive to manufacture.

It is another object of the present invention to provide an automatic bead threading toy which may be operated by small children.

It is still another object of the present invention to provide an automatic bead threading toy having an operation which is readily observed and understood by the children playing with the toy.

It is yet another object of the present invention to provide a kinematic toy having an operation which is readily observed by and attracts the attention of the children playing with the toy.

These and other objects and advantages are attained by an automatic bead threading toy device which has a chassis upon which a container for a plurality of beads is mounted. The container has a hole in the bottom thereof through which beads may fall out of the container one-by-one.

A guide wire or like member has its first end mounted into the hole in substantial coaxial alignment with the hole. A second end of the guide wire is adapted to be attached to a thread or line upon which the beads are ultimately assembled. A mechanism is mounted to the chassis which shakes the container so as to cause a continuous random motion of the beads in the container. Each bead has an aperture which is large enough to accommodate the guide wire. As a result of their random motion, the beads, one-by-one, align their respective apertures substantially coaxially with the end of the guide wire and slide down on the guide wire. A rotating bead advancing assembly is operatively associated with an intermediate portion of the guide wire. The bead advancing assembly is adapted to move the beads, one-by-one, on the guide wire to the second end of the guide wire for mounting onto an attached thread or line.

The objects and features of the present invention are set forth in the appended claims. The present invention may be best understood by reference to the following description, taken in connection with the accompanying drawings in which like numerals indicate like parts.

BRIEF DESCRIPTION OF THE DRAWINGS

FIG. 1 is a perspective view of a first preferred embodiment of the bead threading toy of the present invention;

FIG. 2 is a cross sectional view of the first preferred embodiment of the bead threading toy of the present invention, the cross section being taken on lines 2—2 of FIG. 1.

FIG. 3 is a perspective view showing a positioning of a guide wire within a rotatable member of a bead advancing mechanism of the first preferred embodiment of the bead threading toy of the present invention;

FIG. 4 is a cross sectional view of a bead showing the guide wire in an aperture of the bead;

DESCRIPTION OF THE PREFERRED EMBODIMENT

Figure 5:
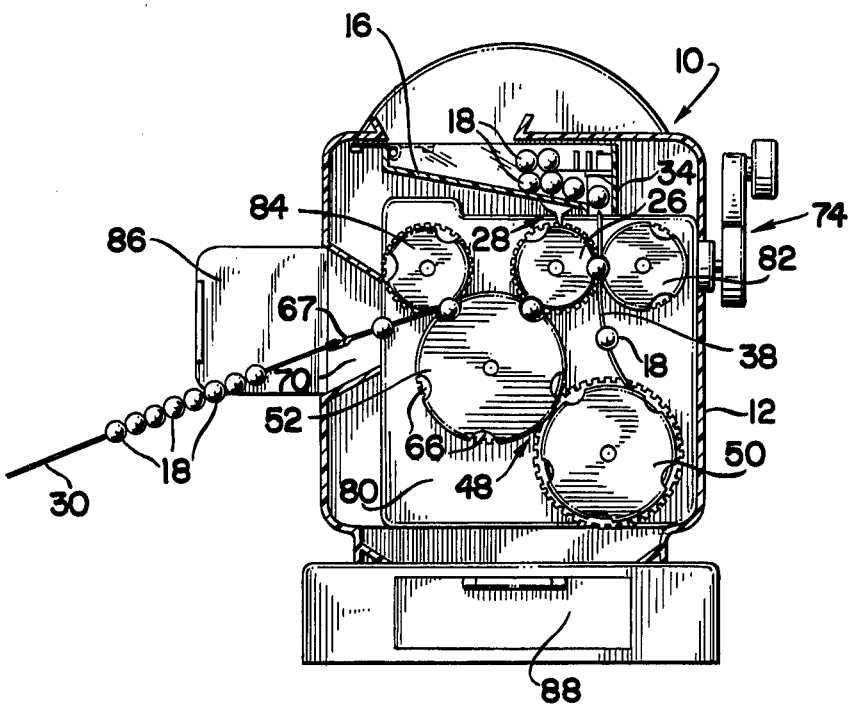
FIG. 5 is a cross sectional view of a second preferred embodiment of the bead threading toy of the present invention, the cross section being analogous to a cross section taken on lines 2—2 of FIG. 1.

The following specification taken in conjunction with the drawings sets forth the preferred embodiments of the present invention in such a manner that any person skilled in the toy manufacturing arts can practice the invention. The embodiment of the invention disclosed herein is the best mode contemplated by the inventors for carrying out their invention in a commercial environment, although it should be understood that various modifications can be accomplished within the parameters of the present invention.

Referring now to the drawings and particularly to the perspective view of FIG. 1, a first preferred embodiment of the bead threading toy 10 of the present invention is disclosed. The bead threading toy 10 includes a frame or chassis 12 which is supported upon a substantially horizontally disposed mounting plate 14. The frame or chassis 12 is preferably manufactured from a transparent plastic material so that the hereinafter described operation of the bead threading toy 10 may be viewed by a child playing with the toy 10. The exact structure of the frame or chassis 12 is, however, not critical for the purpose of the present invention and therefore a detailed description of the chassis 12 is not deemed necessary.

A box shaped container 16 for beads 18 is pivotably mounted on top of the chassis 12 with a pivot pin 20 being positioned substantially at one end of the container 16. The pin 20 acts as a fastener and hinge. An opening 22 is provided in the container 16 wherethrough a supply of the beads 18 may be placed into the container 16. A bottom 24 of the container 16 is in contact with a ratchet type wheel 26 which forms part of a vibrating or shaking assembly 28. The purpose of the shaking assembly 28 is described below.

The beads 18 shown on FIG. 1 are of a customary substantially spherical variety, although the bead threading toy 10 of the present invention may also be adapted for automatically threading beads of other than a substantially spherical shape. In order to allow the beads 18 to be threaded upon a line or thread 30, each bead 18 has an aperture 32 substantially in the center thereof, as is shown on FIG. 4. This is, of course, in accordance with standard practice in the art.

An outlet port 34 is located in the bottom 24 of the container in a position substantially adjacent to the pin 20 which connects the container 16 to the chassis 12. The purpose of positioning the outlet port 34 in close proximity to the hinge pin 20 substantially at a low point of the container 16 is to allow all of the beads 18 to fall out of the container 16 during the operation of the toy 10.

The outlet port 34, in the herein described first preferred embodiment comprises a circular aperture 36. The aperture 36 is dimensioned to allow only one bead 18 at a time to fall through it. In other words, the geometrical diameter of the circular aperture 36 is only slightly larger than the geometrical diameter of the spherical beads 18.

A substantially rigid thin guide member or guide wire 38 is mounted to the chassis 12. A first free end 40 of the guide wire 38 is disposed substantially in the center of the aperture 36 of the outlet port 34. A portion 42 of the wire 38 which is immediately contiguous to the first end 40, is disposed substantially vertically. Therefore, a bead 18 falling onto the first end 40 of the wire 38, with the wire 38 being substantially aligned with the aperture of the bead 18 falls out of the container 16 while sliding on the wire 38.

A subsequent portion of the wire is configured substantially in the shape of the letter S. This S shaped portion of the wire is best illustrated on FIG. 2 and bears the reference numeral 46. The S shaped portion 46 of the wire 38 is operatively associated with a bead advancing assembly 48 which is described in detail as follows.

A first rotatable member 50 and a second rotatable member 52 are mounted to the chassis 12 upon substantially horizontally disposed axles. The axles which are substantially parallel to one another bear the reference numeral 54 on FIGS. 1 and 2. Each rotatable member 50 and 52 comprises a pair of round disks with a groove or channel 58 being located between the disks. In other words, the rotatable members 50 and 52 of the herein described first preferred embodiments comprise pulleys. A gear 60 comprises part of each rotatable member and is attached to each pulley 4 to rotate in unison therewith. The respective gears 60 of the rotatable members 50 and 52 mesh with one another. As a result, rotation of the first rotatable member 50 in a clockwise direction causes rotation of the second rotatable member 52 in a counter clockwise direction, as is shown by the arrows on FIG. 2.

The S shaped portion 46 of the wire 28 is disposed in the grooves or channels 58 of the first and second rotatable members 50 and 52 in such a manner that the wire 38 is partially situated between the two rotatable members 50 and 52.

The disks 62 of the rotatable member 50 and 52 have on their respective circumference 64 a plurality of cut-away portions 66. The cut-away portions 66, best shown on FIG. 2, are configured in a shape capable of temporarily interfacing with and capturing the beads 18 while the beads 18 slide on the wire 38. As is described in detail below, the beads 18 temporarily captured in the cut-away portions 66 are advanced on the wire 38 by the rotatable members 50 and 52. The cut-away portions 66 of the two rotatable members 50 and 52 are positioned on the disks 62 so that during rotation of the disks 62 two cut-away portions 66 come into close proximity of one another in the area where the two pulleys of the rotatable members 50 and 52 are closest to one another. This renders possible the transfer of a bead 18 from one cut-away portion 66 into another.

A second end 67 of the guide wire 38 has the thread or a line 30 attached to it upon which the beads 18 are to be assembled. In order to facilitate attachment of the thread or line 30 to the second end 67 of the wire 38 a small hook 68 or the like may be provided on the wire 38. The hook 68 must, however be small enough to allow passage of the beads 18 from the wire 38 onto the line 30. A weight 69 is attached to the line 30 to keep the line 30 tautly suspended in a substantially vertical position. The bead threading toy may be placed at the edge of a table (not shown) or the like in order to allow the aforementioned vertical positioning of the line 30. The second end 67 of the guide wire 38 is positioned in an outlet duct 70 assembled to the chassis 12. The outlet duct 70 similarly to the chassis 12, is preferably manufactured from a transparent plastic material, as is shown on FIG. 1.

Referring now principally to FIG. 2, the shaking mechanism or assembly 28 is described. The ratchet type wheel 26 is mounted to the chassis 12 so as to come into contact with the bottom 24 of the container 16. A first gear 71 is mounted to the ratchet wheel 26, and the first gear 71 is meshed with a second gear 72. The second gear 72, in turn, is driven by a hand actuated crank assembly 74. The second gear 72 also meshes the gear 60 of the first rotatable member 50 so that rotation of the crank assembly 74 also drives the bead advancing assembly 48. It is readily apparent that rotation of the ratchet wheel 26 causes the container 16 to undergo a relatively rapid up-and-down vibrating or shaking motion relative to the chassis 12.

Having described the principal structural components of the first preferred embodiment of the automatic bead threading toy 10 of the present invention, the operation of the toy 10 is explained as follows. A child player (not shown) performs the bead threading process merely by turning the crank assembly 74. This shakes the container 16, and shaking of the container 16 causes the beads 18 to undergo a random motion in the container 16. The random motion of the beads 18 results in random orientation of the beads 18 relative to the outlet port 34 and to the first end 38 of the guide member or wire 38. As the shaking continues, the beads 18 orient themselves one-by-one with their respective aperture 32 in coaxial alignment with the first end 38 and vertical portion 42 of the wire 38. The aperture 32 in one of the heads 18 is best shown on FIG. 4. Then the beads 18 fall one-by-one through the outlet port 34 while sliding on the guide wire 38.

Subsequently, each bead 18 is captured by one of the cut-away portions 66 of the first rotatable member 50. The bead 18 is then advanced in a fixed displaced spatial position on the S shaped portion 46 of the wire 38 and is transferred into one of the cut-away portions 66 of the second rotatable member 52. The bead 18 is then further advanced on the S shaped portion 44 until it is finally released to slide down on the guide wire 38 towards the second end 67 of the wire 38. From the second end 67 the beads 18 fall one-by-one onto the thread or line 30. A child player (not shown) may, when he so wishes, discontinue turning the crank assembly 74 thereby stopping the bead threading process. Subsequently, he may remove the beads 18 assembled on the line 30 from the second end 67 of the wire 38.

The above described bead threading process may be readily followed and understood by the inspection of the drawing figures. The fact that a child player (not shown) may also view the process through the transparent chassis 12 further enhances the play value of the toy 10 and contributes to a child's learning process. Therefore, the toy 10 of the present invention is, apart from its utility as a bead threading toy, also useful as a visual kinematic toy having an operation which is highly educational and fascinating for children. Utility of the toy 10 as a visual kinematic toy becomes even further apparent in conjunction with the description of a second preferred embodiment, wherein the bead threading process may be entirely eliminated.

Figure 6:
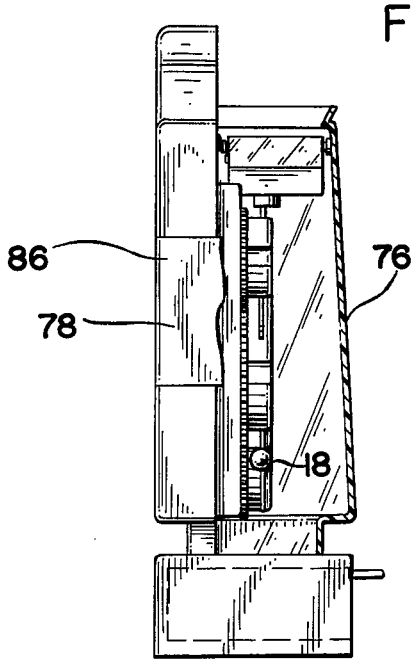
FIG. 6 is a partial cross sectional side view of the second preferred embodiment of the bead threading toy of the present invention.

Referring now to FIGS. 5 and 6, the second preferred embodiment of the toy 10 of the present invention is disclosed. The second preferred embodiment is in most respects identical or similar in construction to the first preferred embodiment. Therefore, it is described in significantly less detail than the first preferred embodiment.

The second preferred embodiment of the bead threading toy 10 has a chassis 12 which includes a transparent front panel 76 and side panels 78 having transparent portions. A substantially vertically disposed non-transparent panel 80 conceals part of mechanism of the crank assembly 74 from view and acts as support to the hereinafter described bead advancing mechanism 48 and shaking mechanism 28.

The second preferred embodiment, as the first preferred embodiment, includes a container 16 for the beads 18 which is shaken by a rotating ratchet wheel 26 of the shaking mechanism 28. The beads 18 fall out of the container 16 through a circular outlet port 34 to slide down on the guide wire 38. A portion of the crank assembly 74 which causes rotation of the ratchet wheel 26 is not shown on FIGS. 5 and 6.

Two additional gears are provided in the second preferred embodiment as compared to the first preferred embodiment. These are indirectly driven by the crank assembly 74. The two additional gears respectively bear the reference numerals 82 and 84. They respectively engage the ratchet wheel 26 and a second rotatable member 52 which also engages a first rotatable member 50. The first and second rotatable members 50 and 52 have the same function in the second preferred embodiment as in the first preferred embodiment; i.e. they engage an S shaped portion 46 of the guide wire 38 and advance the beads 18 until the beads 18 are finally deposited from a second end 67 of the guide wire 38 to an attached thread or line 30. For this purpose, the first and second rotatable members 50 and 52 have cut-away portions 66 which, as described for the first preferred embodiment, temporarily capture and advance the beads 18.

The additional gears 82 and 84 are not essential for the operation of the second preferred embodiment of the bead threading toy 10. Rather, they merely enhance the sophisticated "machinery like" appearance of the bead threading toy 10, and thereby enhance the pleasure of the children playing with the toy.

The second preferred embodiment of the automatic bead threading toy 10 of the present invention includes a hinged door 86 which provides access to an outlet duct 70 of the chassis 12. The side view of FIG. 6 shows the hinged door 86 in a closed position while FIG. 5 shows the same in an open position. A drawer 88 is incorporated in the chassis 12 below the bead advancing mechanism 48. The beads 18 fall into the drawer 88 whenever the hinged door 86 is closed and the bead advancing mechanism 48 is operated. Thus, a child playing with the second preferred embodiment of the bead threading toy 10 of the present invention has the play option of removing the thread or line 30, closing the door 86 and collecting the beads in the drawer 88 wherefrom they may be again transferred into the container 16. In this mode, the second preferred embodiment of the toy 10 of the present invention operates as an educational, visually fascinating kinematic toy.

What has been described above is a bead threading toy which is readily operated even by small children. Several modifications of the above described toy may become readily apparent to those skilled in the art in light of the above disclosed generic concepts. Therefore, the scope of the present invention should be interpreted solely from the following claims.

What is claimed is:

1. A toy device for threading a plurality of small objects on a thread and the like, the device comprising:

a chassis;

a container moveably mounted relative to the chassis and adapted for holding the plurality of small objects, each of the small objects having a substantially straight aperture penetrating through a portion of the small object, the container having an outlet port adapted for allowing passage under the force of gravity of only one of the small objects at a time through the port;

an elongated thin guide member mounted to the chassis and having a first and a second end, the first end of the guide member being disposed in operative relationship with the outlet port of the container, the second end of the guide member being adapted for operative connection to the thread and the like, the guide member being sufficiently thin so as to allow each of the small objects to pass from the first end of the guide member to the second end of the guide member with the guide member penetrating through the aperture of the small object;

first means mounted relative to the chassis for shaking the container, the shaking motion being of such magnitude to generate random positioning of the small objects relative to the port and the first end of the guide member, the small objects as a result of the varying random positioning capable of falling through the outlet port with the guide member being disposed in their respective aperture, whereby the toy device is capable of passing the small objects from the container onto the thread and the like.

2. The invention of claim 1 further comprising second means mounted to the chassis and adapted for moving the small objects in a predetermined translating movement toward the second end of the guide member.

3. The invention of claim 2 wherein the first end of the guide member is disposed in coaxial alignment with the outlet port.

4. The invention of claim 2 wherein the guide member is a substantially rigid wire.

5. The invention of claim 2 wherein the second means comprises a first and a second rotatable member capable of rotating in directions opposite to one another, a portion of the guide member being disposed between the first and second rotatable members and along a portion of the respective circumferences of the first and second rotatable members, the first and second rotatable members each having at least one cut-away portion adapted for temporarily capturing one of the small objects and sliding the small object on the wire, the cut-away portions of the first and the second rotatable members being positioned so that when the rotatable members rotate, the temporarily captured small object is transferred from the cut-away portion of the first rotatable member to the cut-away portion of the second rotatable member which further slides the small object along the wire, and finally releases the small object allowing it to proceed towards the second end of the wire.

6. The invention of claim 5 wherein the first and second rotatable members each comprise a pulley attached to a gear for rotation therewith, the gears attached to the pulleys being in contact with one another, a peripheral groove being located in each pulley wherein the wire is positioned in an S configuration, the pulleys incorporating the cut-away portions.

7. The invention of claim 6 wherein the first means and the second means are operatively connected to a crank mechanism manually driven by an operator.

8. The invention of claim 7 wherein the first means comprise a ratchet wheel having a toothed circumference in contact with a bottom of the container, the ratchet wheel being rotated by the crank mechanism and repeatedly lifting the container as each tooth thereof comes into contact with the bottom of the container.

9. A toy device adapted for threading beads onto an elongated support member such as a thread, the device comprising:

a chassis;

a container adapted for holding a plurality of beads, each bead having an aperture, the container being mounted to the chassis and including a bottom having an outlet hole through which beads may fall under the force of gravity, the hole being dimensioned to allow only one bead to fall through the hole at one time;

a wire mounted to the chassis having a first end, a second end, and an intermediate portion, the first end of the wire being disposed in the outlet hole in substantial coaxial alignment with the hole and the second end of the wire being adapted for attachment to a thread upon which the beads may be threaded;

first means adapted for advancing the beads towards the second end of the wire, the first means being operatively associated with the intermediate portion of the wire, and second means adapted for causing the beads in the container to undergo a motion whereby the beads will sequentially fall into the outlet hole and orient themselves with their respective aperture situated in substantial coaxial alignment with the first end of the wire and slip on the wire to be further advanced by the first means on the wire towards the second end of the wire.

10. The invention of claim 9 wherein the intermediate portion of the wire has an S configuration, and wherein the first means comprise a first and a second rotatable member rotating about substantially parallel axes of rotation in directions opposite to one another, each rotatable member having a circumferential groove and at least one cut-away portion disposed in the respective circumference of the rotatable member, the intermediate portion of the wire being partially disposed in the circumferential grooves and between the first and second rotatable members; the cut-away portion of the first rotatable member being adapted for temporarily capturing beads one-by-one, sliding the beads along the wire and transferring the beads into the cut-away portion of the second rotatable member, the cut-away portion of the second rotatable member ultimately releasing the beads allowing them to slide towards the second end of the wire.

11. The invention of claim 9 wherein the first means comprise a first pulley and a second pulley mounted for rotational movement about substantially parallel axes, each pulley having a conventional groove, the intermediate portion of the wire being partially situated between the respective grooves of the first and second pulleys, the pulleys having third means adapted for temporarily capturing the beads one-by-one and moving the beads one-by-one along the wire towards the second end.

12. The invention of claim 11 wherein the first means further include two gears, one gear being fixedly attached to each pulley, the gears being meshed with one another whereby rotation of the first pulley causes rotation of the second pulley in an opposite direction.

13. The invention of claim 11 wherein the intermediate portion of the wire has an S configuration.

14. The invention of claim 9 further comprising a hand actuated crank being rotatably mounted to the chassis, and a gear attached to the crank, the crank driving the first and second means through the gear.

15. The invention of claim 9 wherein the container is pivotably mounted to the chassis and wherein the second means includes means for causing an up-and-down pivoting motion of the container relative to the chassis.

16. The invention of claim 9 wherein the first means is enclosed within the chassis and the chassis is at least partially transparent whereby operation of the toy device may be viewed by a player.

17. The invention of claim 9 further including storage means for receiving beads falling from the second end of the wire including a retrevial drawer member.

* * * * *